United States Patent [19]

Mason

[11] 3,945,195

[45] Mar. 23, 1976

[54] ULTRA THIN ELECTRONIC WATCH WITH IMPROVED VISIBILITY DISPLAY

[75] Inventor: Daniel W. Mason, Scottsdale, Ariz.

[73] Assignee: Motorola, Inc., Chicago, Ill.

[22] Filed: Jan. 13, 1975

[21] Appl. No.: 540,371

[52] U.S. Cl. ..... 58/23 R; 58/23 BA; 58/50 R

[51] Int. Cl.[2] ..... G04C 3/00

[58] Field of Search.. 58/23 R, 23 BA, 50 R, 127 R, 58/126 R; 320/2, 3; D10/29–32, 38

[56] References Cited

UNITED STATES PATENTS

| | | | |
|---|---|---|---|
| 3,505,804 | 4/1970 | Hofstein | 58/23 BA |
| 3,608,304 | 9/1971 | Schaad | 58/23 BA |
| 3,672,155 | 6/1972 | Bergey et al. | 58/50 R |
| 3,757,511 | 9/1973 | Burgess et al. | 58/127 R |
| 3,854,278 | 12/1974 | Takeshita et al. | 58/50 R |
| 3,855,784 | 12/1974 | Foellner | 58/50 R |

*Primary Examiner*—Ulysses Weldon

*Attorney, Agent, or Firm*—Willis E. Higgins; Harry M. Weiss

[57] ABSTRACT

In an electronic watch having a body of substantially reduced thickness obtained by having portions of the top surface of the watch extend above the remainder of the top surface, a liquid crystal or other passive display extends into one of the portions of the top surface extending above the remainder of the top surface. In addition to having the top surface of this portion substantially transparent, side walls of the portion are also substantially transparent in order to allow light to enter the display from the sides of the portion as well as its top. The sides may be shaped to concentrate light entering them on the display. Additional light entering the display from the sides of the raised portion enhances visibility of the display substantially, particularly in dim light conditions.

4 Claims, 3 Drawing Figures

ULTRA THIN ELECTRONIC WATCH WITH IMPROVED VISIBILITY DISPLAY

CROSS REFERENCE TO RELATED APPLICATION

This application covers an improvement in the invention described and claimed in a concurrently filed, copending, commonly assigned application Ser. No. 540,370, filed on Jan. 13, 1975, in the name of R. Gary Daniels and entitled "Ultra Thin Electronic Watch."

FIELD OF THE INVENTION

This invention pertains to an electronic watch. More particularly, it relates to such a watch having a body of substantially reduced thickness obtained in part by having the display element of the watch extend above the remainder of the top surface of the watch. Most especially, it relates to such a watch of reduced thickness in which visibility of the display element is enhanced.

The above referenced Daniels application describes an electronic watch of reduced thickness in which a portion of the top surface of the watch extends above the remainder of the top surface of the watch. The display for the watch extends into this portion above the remainder of the top surface of the watch.

Electronic watches employing liquid crystal or other passive (i.e., which do not actively generate light) display elements are known in the prior art. In such liquid crystal displays, light entering the display from its top is typically allowed to pass through the display and be reflected back to the observer. This light is selectively blocked in portions of the display to create visible numbers or other indicia.

While such liquid crystal display (LCD) watches are presently commercially available, they have not achieved the same degree of consumer acceptance as the older light emitting diode (LED) watches. A primary reason for the difference in consumer acceptance of these two major types of electronic watches lies in the difference in visibility of LCDs compared with LEDs. The lesser visibility of LCD displays is especially of significance in dim lighting conditions. Thus, any improvement in the design of LCD watches which will increase the visibility of the LCDs in dim light conditions is of substantial importance.

SUMMARY OF THE INVENTION

Accordingly, it is an object of this invention to provide an electronic watch of reduced thickness having a passive display of improved readability.

It is another object of the invention to provide an electronic watch of reduced thickness having a liquid crystal display in which light enters the display from both its top and its sides.

It is a further object of this invention to provide an LCD watch in which the display has improved visibility under dim light conditions.

These and related objects may be achieved through use of the electronic watch structure herein disclosed. The present invention is an improvement in ultra thin electronic watches of the type in which a watch body of substantially reduced thickness is obtained in part by having a portion of the top of the watch body extend above the remainder of the top and having the display element extend above the remainder of the top of the watch body into the raised portion. In such a structure, the top of the raised portion is substantially transparent to allow viewing the display. In accordance with the improvement of this invention, the sides of the raised portion are also transparent, and the display extends a sufficient amount into the raised portion to allow light entering the sides of the raised portion to enter the display. The sides of the raised portion are preferably shaped to concentrate the light entering them on the display. The additional light entering the display from the sides of the raised portion noticeably enhances visibility of the display, particularly in dim light conditions.

The attainment of the foregoing and related objects, advantages and features of the invention should be readily apparent after review of the following more detailed description of the invention, taken in conjunction with the drawings in which:

DETAILED DESCRIPTION OF THE INVENTION

Figure 1:
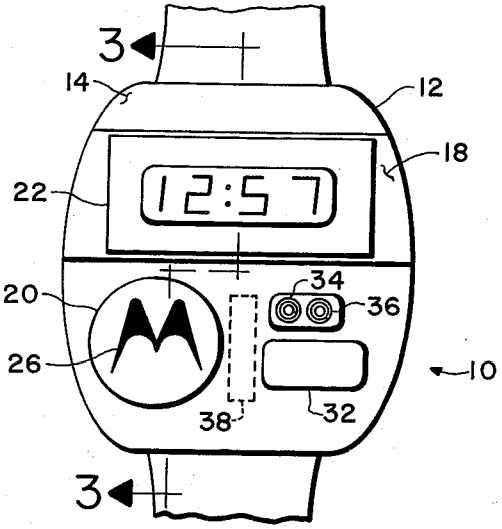
FIG. 1 is a plan view of a watch in accordance with the invention.
Figure 2:
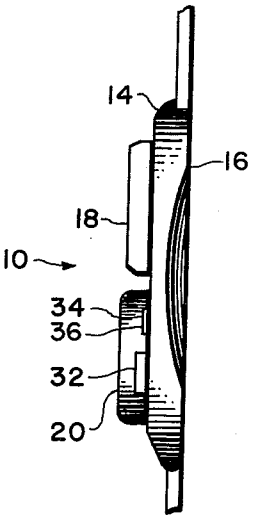
FIG. 2 is a side view of the watch in FIG. 1.
Figure 3:
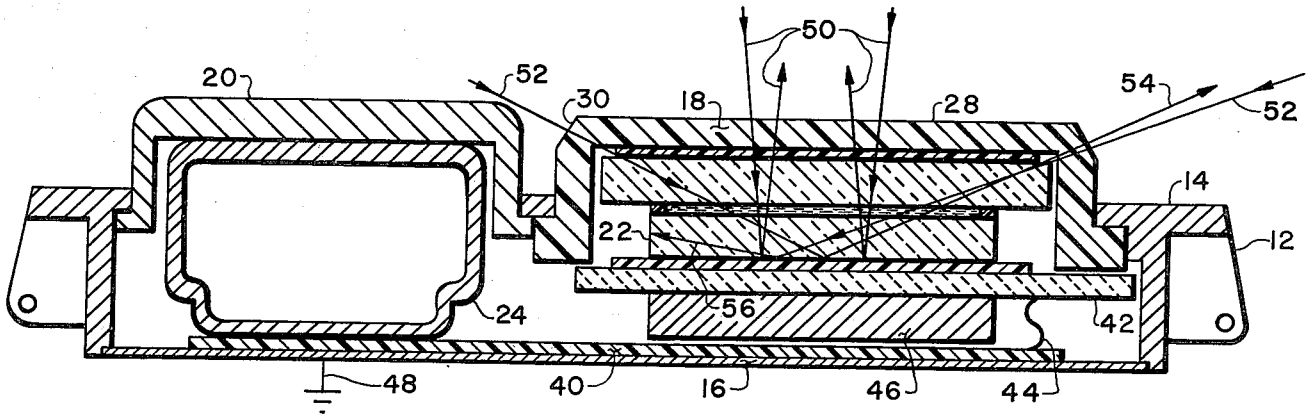
FIG. 3 is an enlarged cross section view of the watch in FIG. 1, taken along the line 3—3.

Turning now to the drawings, more particularly to FIGS. 1–3, there is shown an embodiment of an electronic watch utilizing the invention. The watch 10 has a case 12 with a top surface 14 and a bottom surface 16 (see FIGS. 2 and 3). It can be seen that the top surface 14 and bottom surface 16 define an overall thickness for the main body of the watch.

Portions 18 and 20 extend above the remainder of top surface 14. As is best shown in FIG. 2, LCD 22 extends up into the portion 18. In a similar manner, battery 24 extends up into the raised portion 20.

Raised portion 20 is friction fit into top surface 14 of the watch so that it can be easily removed for access to battery 24. Alternatively, top surface 14 and portion 20 could be screw threaded or keyed for easy removal of portion 20. Raised portion 20 is also a desirable location for a trademark for the watch, such as the stylized M 26, a trademark of Motorola, Inc.

The raised portion or cover 18 having LCD 22 extending into it has a transparent upper surface 28 to allow observation of the LCD. As is best shown in FIG. 3, sides 30 of raised portion 18 are transparent as well. This improves visibility of the LCD by allowing light to enter it from the sides 30 of raised portion 18 as well as its upper surface 28.

The watch has a demand switch 32 for initiating the display of seconds by LCD 22, rather than hours and minutes as are usually displayed. If desired, the second demand switch 32 may also cause the date to be displayed momentarily after the seconds display has been terminated and before return to the usual hours and minutes. Inset switches 34 and 36 are provided to set the hours and minutes of the watch, respectively. They are actuated by depressing them with a sharp object, such as a pin or a pencil point. The switches 32, 34 and 36 also extend above the top surface 14 of the watch.

A quartz crystal 38 is mounted in the case beneath seconds demand switch 32. High frequency oscillations of the quartz crystal 38 are divided down to lower frequencies in the watch in order to provide the indication of time. A flexible printed circuit board 40 connects battery 24 and quartz crystal 38 to substrate 42 by means of wire 44. Substrate 42 has one or more integrated circuit chips 46 mounted on one side, which contain frequency divider circuit, decoder circuits and the like necessary for operation of the watch. LCD 22 is connected to the other side of substrate 42. Case 12 is grounded, as shown schematically by connection 48.

Detailed operation of the circuitry in the present watch will not be explained, since operation of the circuitry is known in the art and does not constitute a part of the present invention. Basic operation of the LCD 22 is also known in the art. Operation of such displays is summarized in, for example, Gurtler and Maze, "Liquid Crystal Displays," IEEE Spectrum, November 1972, p. 25, the disclosure of which is incorporated by reference herein. The display 22 operates in a reflective mode, in which light represented by arrows 50 enters the display from its top and is reflected from its back surface. In order to provide the display of numerals to indicate time, reflection of the light is selectively blocked by selective application of an electric field to a conventional seven segment pattern for each numeral. Additionally, by virtue of the present invention, light is allowed to enter the display 22 from transparent sides 30 of cover 18, as indicated by arrows 52. Some of this light is reflected back out of the display as indicated by arrows 54, and some of this light merely increases the background light intensity of the display 22 as indicated by arrow 56. When compared with both a conventional LCD watch in which the display is not raised above the top surface of the watch and a watch in which the display is raised above the top surface of the watch but in which the cover of the display does not have transparent sides, a noticeable increase in brightness of the display, particularly in dim light conditions, is observed.

It should now be apparent that an improved electronic watch capable of achieving the stated objects of the invention has been provided. By having the display of the watch extend above the top surface of the watch case and providing transparent sides on the cover for the display, improved readability of the LCD display is obtained.

While the invention has been described in detail with reference to a preferred embodiment thereof, it will be apparent to those skilled in the art that various changes in form and details may be made therein. It is intended that such modifications be covered within the spirit and scope of the claims appended hereto.

What is claimed is:

1. In an electronic watch:

a case having top and bottom surfaces generally parallel to each other, the distance between the top and bottom surfaces defining a body of thickness of said watch, a cover having a substantially transparent top and four sides substantially transparent occupying a first portion of and extending above the top surface of said case, and a passive display extending into said cover above the top surface of said case a sufficient extent to allow light entering the sides of said cover to enter said display, thereby increasing its brightness and making said display easier to read, and a second portion of said case adjacent one of said four sides of said cover and extending above the top surface of said case, a part of said battery extending above the top surface of said case into said second portion of said case.

2. The electronic watch of claim 1 in which said display is a liquid crystal display.

3. An electronic watch comprising:

a case having top and bottom surfaces generally parallel to each other, the top and bottom surfaces defining a body thickness of said watch;

a lens having a substantially transparent top and substantially transparent occupying a first portion of and extending above the top surface of said case, a passive display extending into said lens above the top surface of said case a sufficient amount to allow light entering the sides of said lens to enter said display, thereby increasing its brightness and making the display easier to read, a battery partially in said case, a quartz crystal in said case which oscillates at a predetermined frequency, electrical circuitry operatively connecting said battery, quartz crystal and display, and a second portion of said case adjacent one of said four sides of said cover and extending above the top surface of said case, a part of said battery extending above the top surface of said case into said second portion of said case.

4. The electronic watch of claim 3 in which said display is a liquid crystal display.

* * * * *